US005779547A

United States Patent [19]

SoRelle et al.

[11] Patent Number: 5,779,547

[45] Date of Patent: Jul. 14, 1998

[54] PARI-MUTUEL GAMING SYSTEM AND METHOD OF USING SAME

[75] Inventors: J. Paul SoRelle, Greeley; Michael G. Martinek, Fort Collins, both of Colo.

[73] Assignee: Thunderbird Greeley, Inc., Greeley, Colo.

[21] Appl. No.: 784,283

[22] Filed: Jan. 16, 1997

[51] Int. Cl.[6] ..... A63F 9/22

[52] U.S. Cl. ..... 463/28

[58] Field of Search ..... 463/12, 13, 16, 463/25, 26, 27, 28, 30, 40, 41, 42; 364/412; 273/138.2, 143 R

[56] References Cited

U.S. PATENT DOCUMENTS 5,275,400 1/1994 Wingardit et al. ..... 364/412 X

*Primary Examiner*—Jessica Harrison
*Assistant Examiner*—Michael O'Neill
*Attorney, Agent, or Firm*—Higgs, Fletcher, & Mack LLP; Bernard L. Kleinke

[57] ABSTRACT

The pari-mutuel gaming system includes an account mechanism for establishing a player's account and a common player pool account. A dynamic paytable which is changeable for each individual play of the game advises the player of the exact amount of currency for all possible winning outcomes of the play to heighten the level of interest of the player. A payout device determines if a winning outcome is achieved for an individual game play, and transfers an award corresponding to the winning outcome from common player pool account to the player's account at the conclusion of the individual game play.

23 Claims, 7 Drawing Sheets

PARI-MUTUEL GAMING SYSTEM AND METHOD OF USING SAME

TECHNICAL FIELD

The present invention relates in general to an improved gaming system and a method of operating it. The invention more particularly relates to a pari-mutuel gaming system which may be used to facilitate the playing of a game of chance, such as a video poker game, a slot or reel machine game, or an automated keno game, and which can be operated according to a novel method.

BACKGROUND ART

There have been many types of gaming systems for playing games of chance, such as video poker machines, and slot or reel machines. For example, reference may be made to the following U.S. Pat. Nos.: 5,275,400 and 5,476,259.

A pari-mutuel gaming machine is disclosed in U.S. Pat. No. 5,275,400, wherein the payouts for winning outcomes are based on a pari-mutuel system. The gaming machine enables a player or players to compete for a common pari-mutuel pool funded by the player or players, thus eliminating the need for a gaming establishment to function as the "bank" for the game.

Each player can accrue credits for playing the game of chance by inserting currency. Upon receipt of the currency, the gaming machine allots a proportional number of credits to the player's credit account. A portion of the currency deposited by the player is registered to the common pari-mutuel pool. The remainder of the deposited currency is registered to a house commission pool designated for the gaming establishment as compensation for maintaining the gaming machine.

The player can wager one or more credits from the player's credit account on the outcome of a game play. If the outcome results in a win for the player, a designated number of credits are credited to the player's credit account. The play continues until the player cashes out the player's credit account.

The cash out currency value of the player's account is dependent upon a per credit value for each of the credits in the player's credit account at the time that the player cashes out. The per credit value is calculated at the time of cashing out by dividing the total amount of currency registered in the common pari-mutuel pool by the total number of currently outstanding credits accumulated by all players. The per credit value is then multiplied by the total number of credits in the player's credit account to obtain the amount paid out to the player from the common pari-mutuel pool.

U.S. Pat. No. 5,476,259 discloses an electronic pari-mutuel gaming machine substantially as disclosed in U.S. Pat. No. 5,275,400, and also discloses a live pari-mutuel gaming system which operates in substantially the same manner as the electronic gaming machine of U.S. Pat. No. 5,275,400.

While such game devices may have enabled games of chance to be played in a pari-mutuel manner, the ability to attract players has been somewhat limited. In this regard, the player is not informed of the exact amount of money won for a winning outcome after an individual game play. Instead, the player is only informed of the number of credits that were won. The information regarding the credits is essentially meaningless to the player in so far as knowing the amount of currency won as the credits do not necessarily correspond to the amount of currency won. As a result, the player is unable to correlate the player's incremental winnings with a dollar amount, thereby reducing the player's appreciation of the player's wins and losses.

Furthermore, the total value of the player's account balance is not known until the player cashes out. The per credit value is only determined at the time that a player cashes out. In addition, the value of the common pool at the time of cashing out is utilized. Thus, it is not possible for the player to know the status of the player's account balance before cashing out.

Such a gaming machine may confuse a player regarding the relative success of the player's gaming activities. Although the player may feel successful as credits are accumulated, another more successful player may accumulate substantially more credits than the other player. As a result, the per credit value for each of the credits is reduced. Depending upon how successful the other player is, the cash out value for the first mentioned player's account balance could actually be less than the original amount of currency deposited by the player even though the player accumulated a positive net number of credits. Thus, the player may become disinterested in continued participation in the game, or the player may decline to participate at all.

Therefore, it would be highly desirable to have a new and improved pari-mutuel gaming system, which is more interesting and intriguing to play.

SUMMARY OF THE INVENTION

Therefore, the principal object of the present invention is to provide a new and improved pari-mutuel gaming system and a method of operating it, wherein the level of interest by the player is maintained.

Briefly, the above and further objects of the present invention are realized by providing a new and improved pari-mutuel gaming system which can be operated according to a novel method to enhance the enjoyment of the player.

The pari-mutuel gaming system includes an account mechanism for establishing a player's account and a common player pool account. A dynamic paytable which is changeable for each individual play of the game advises the player of the exact amount of currency for all possible winning outcomes of the play to heighten the level of interest of the player. A payout device determines if a winning outcome is achieved for an individual game play, and transfers an award corresponding to the winning outcome from common player pool account to the player's account at the conclusion of the individual game play.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
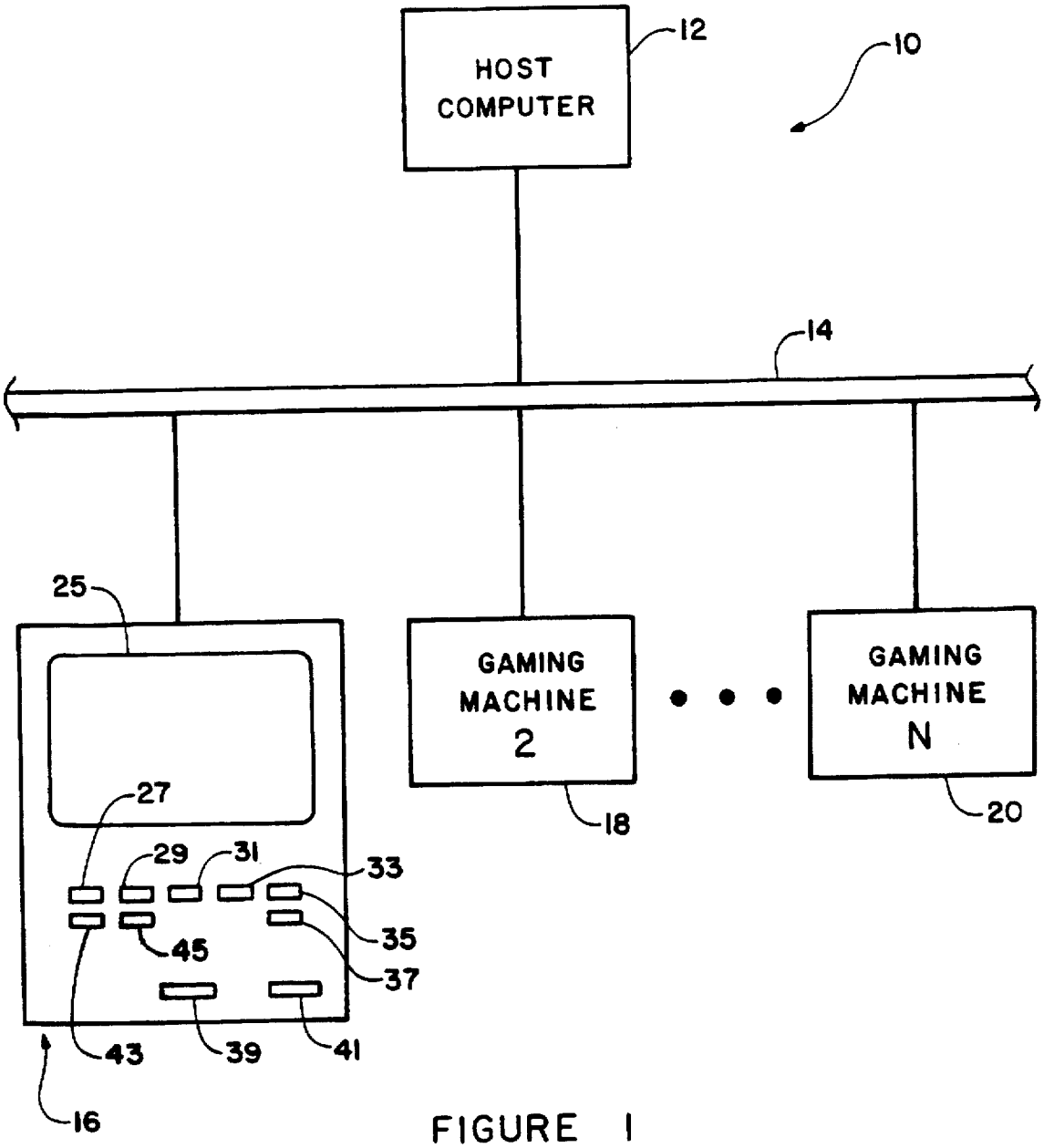
FIG. 1 is a diagrammatic view of a pari-mutuel gaming system, which is constructed in accordance with the present invention.
Figure 7:
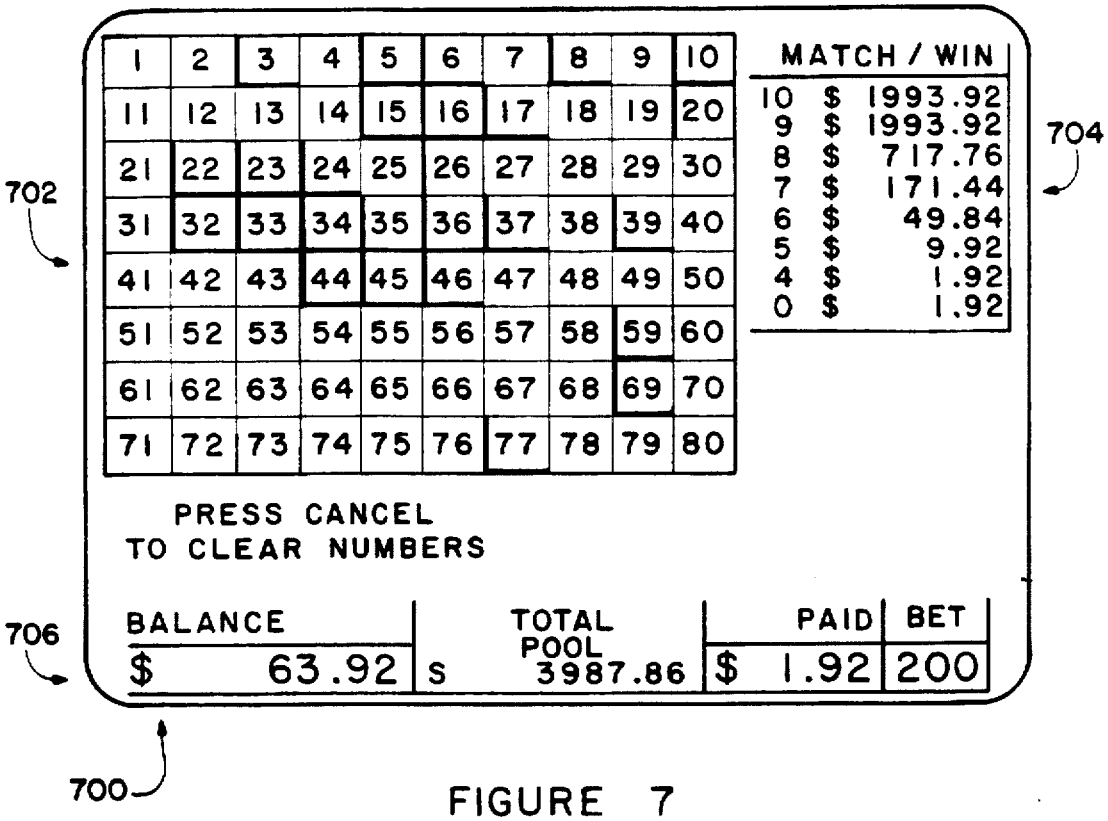
FIG. 7 is a keno game display.

Referring now to the drawings, and more particularly to FIG. 1 thereof, there is shown a pari-mutuel gaming system 10, which is constructed in accordance with the present invention. The gaming system 10 may be used to play any one of a number of games of chance, including a video poker game (FIG. 2), a slot or reel machine game (FIG. 6) and a keno game (FIG. 7).

The gaming system 10 includes a host computer 12 connected electrically to a gaming machine 16 via a bus 14. The computer 12 and the gaming machine 16 cooperate to enable a player (not shown) to participate in a game of chance. Additional gaming machines such as gaming machine 18 and gaming machine 20 can also be connected electrically to the computer 12 to permit additional players (not shown) to participate in the game, and to enable the computer 12 to monitor the activity of the machines 16, 18 and 20

Considering now the gaming machines 16, 18 and 20 in greater detail with reference to FIG. 1, only gaming machine 16 will be described in further detail as the gaming machines 16, 18 and 20 are substantially similar to one another. Gaming machine 16 includes a video display monitor 25 for displaying information to the player, such as the video poker display 200 (FIG. 2), the slot machine display 600 (FIG. 6) and the keno display 700 (FIG. 7).

The gaming machine 16 further includes a plurality of controls for enabling the player to interface with the game. The controls include a bet control 27, a play control 29, a change control 31, a draw control 33, a setup control 35 and a selection control 37, a cash out control 43 and a print out control 45. A bill acceptor/cash out tray 39 accepts currency from the player to participate in the game, and disperses the player's winnings upon cashing out. The player's winnings may be dispersed in currency, or a cash ticket may be provided indicating the player's winnings thereon. The cash ticket can be converted to currency by the establishment maintaining the machine 16.

The gaming machine 16 further includes a ticket printer mechanism 41 for providing a printed statement of account for the machine 16. The statement of account, or audit ticket, will be described hereinafter in greater detail with reference to FIG. 5A–5B.

As the term pari-mutuel indicates, the players compete against one another to receive awards from a common pool. The gaming system 10 can be arranged to set up a common pool for each one of the gaming machines 16, 18 and 20, wherein the player at each machine competes for the common pool for that machine. Alternatively, the gaming machines 16, 18 and 20 can be arranged to share a common pool, wherein the players at the gaming machines 16, 18 and 20 compete against one another for the single common pool.

To facilitate the operation of the gaming system 10 in a pari-mutuel manner, the machine 16 utilizes an account mechanism to establish a player's account, a common player pool account, a house commission account and a reserve or back meter account. The player's account reflects the total of all credits and debits attributed to the player's account in exact dollars and cents. For example, when the player initially inserts currency into a payment mechanism of the machine 16, the player's account is credited with an amount in dollars and cents corresponding substantially to the value of currency inserted.

The common player pool account reflects the total of all credits and debits attributed to the player pool account in exact dollars and cents. All payouts for winning outcomes are generally paid to the player's account from the player pool account. The player pool account is initially funded or seeded by the gaming establishment to an initial value. Subsequently, the seed money can be returned to the gaming establishment according to generally accepted methods.

A betting mechanism enables a substantial portion of each wager made by the player to be transferred from the player's account to the player pool. The resulting player's account balance and the player pool account balance are displayed on the monitor 25. The remainder of the wager is allocated to other accounts, as will be described hereinafter in greater detail.

A portion of each wager is allocated to the house commission account. The house commission portion of the wager is intended to compensate the gaming establishment for maintaining the system 10. The percentage of the wager allocated to the house commission account can be selected to maximize player appeal and to sustain existing levels of play. The preferred house commission percentages are: about 5% to about 7% for eight line video reel games; about 3% to about 5% for video card games; and about 6% to about 9% for keno games.

To avoid the need to reseed the player pool account should its balance fall below a desirable level, a specified portion of each wager is allocated to the back meter account. When winning payouts reduce the player pool account sufficiently, the player pool account is increased at the expense of the back meter account. In this way, the payouts for winning outcomes are kept consistent with their initial values.

In the event that a large payout is awarded and the player pool account is reduced significantly, the machine 16 will allocate the back meter portion of each wager to the player pool account until the player pool account reaches the desirable level again. At this point, the back meter portion will once again be allocated to the back meter account until the player pool account is depleted again.

The preferred percentage of the wager to be allocated to the back meter account is about 9%.

In addition to establishing the player's account, the player pool account, the house commission account and the back meter account, the machine 16 also establishes a jackpot pool account to enhance player appeal. A jackpot award can be assigned to a winning outcome, and will be paid to the player's account from the jackpot pool account.

The jackpot pool account receives an allocation of another portion of each wager. Preferably, the percentage of each wager allocated to the jackpot pool account is about 1%.

The machine 16 further includes a dynamic paytable mechanism for determining the payout corresponding to each winning outcome of an individual game play. A viewable paytable is displayed to the player on the monitor 25. As the player pool account balance varies as the player wins or loses, the paytable is constantly changing for each individual game play.

Each of the payouts is determined, in part, as a percentage of the current player pool account balance. Additional factors, such as the degree of difficulty in obtaining a certain card combination, may also be utilized to determine a payout for that particular card combination.

All winning occurrences of individual game plays are determined by a payout mechanism. In the event of a successful game play, the appropriate payout identified in the paytable is awarded to the player's account from either the player pool account or the jackpot pool account.

At all times during the use of the machine 16, the player is advised of the exact amount that is available to win in the player pool account. Furthermore, the player is always advised of the exact amount of an award for a winning outcome, and of the exact amount in the player's account at any given time.

Upon the conclusion of play at the machine 16, the player can cash out and receive the value of the player's account balance in currency. Alternatively, the player may receive a ticket indicating the player's account balance thereon for redeeming with the gaming establishment for a corresponding amount of currency.

To facilitate audit procedures conducted by the gaming establishment, the machine 16 records all debits and credits attributed to each of the accounts. In this regard, a detailed audit ticket can be created by the machine 16 indicating the debits, credits and net total change for each account, as will be described hereinafter in greater detail. Alternatively, the host computer 12 may be utilized to record the debits, credits and net total change for each of the machines 16, 18 and 10, and to create the audit ticket.

Figure 2:
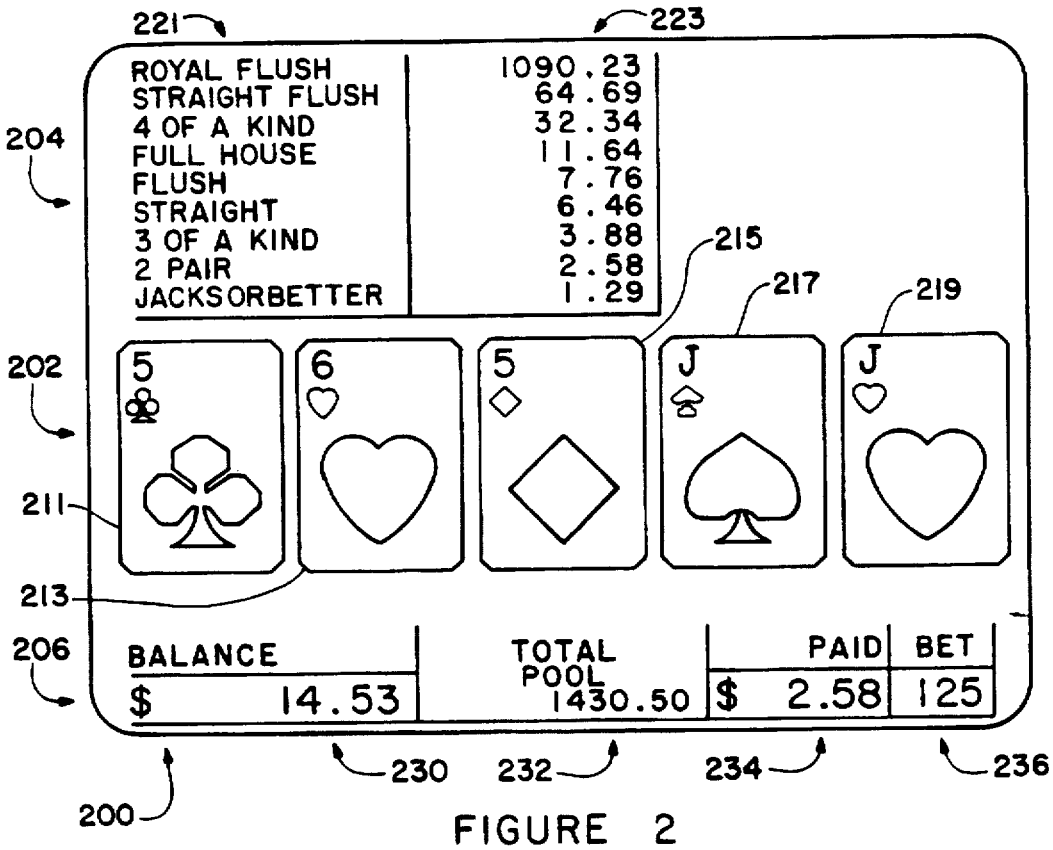
FIG. 2 is a video poker game display of the pari-mutuel gaming system of FIG. 1.

Considering now the video poker display 200 in further detail with reference to FIG. 2, the video poker display 200 includes a card display 202, a dynamic paytable display 204, and a status display 206. The card display 202 indicates the cards in the hand of the player. As shown in FIG. 2, the cards in the player's hand include card 211 (five of clubs), card 213 (six of hearts), card 215 (five of diamonds), card 217 (jack of spades) and card 219 (jack of hearts).

The dynamic paytable display 204 displays the potential awards for winning combinations of cards such as cards 211, 213, 215, 217 and 219. The paytable display 204 includes a winning card combination column 221 and a payout column 223 having payouts or awards corresponding to each winning combination in column 221. As shown in FIG. 2, the player has a pair of fives (cards 211 and 215) and a pair of jacks (cards 217 and 219). By referring to the paytable 204, and locating the winning combination of "2 PAIR" in the winning combination column 221, the player can determine the exact amount of winnings from the payout column 223. As shown in FIG. 2, the two pairs in the player's hand corresponds to an award value of $2.58.

The status display 206 includes a player's account balance display 230, a player pool balance display 232, a payout display 234 and a wager display 236. The award of $2.58 which resulted from the two pairs in the hand of the player is displayed in the payout display 234. The player's account current balance of $14.53, including the award of $2.58, is indicated in the player's account balance display 230. The underlying wager of $1.25 is indicated in the wager display 236. The current value of the common pari-mutuel pool is displayed in the player pool balance display 232, which represents the value of the common pool after the $2.58 award was made to the player's account balance from the common pool.

Figure 3:
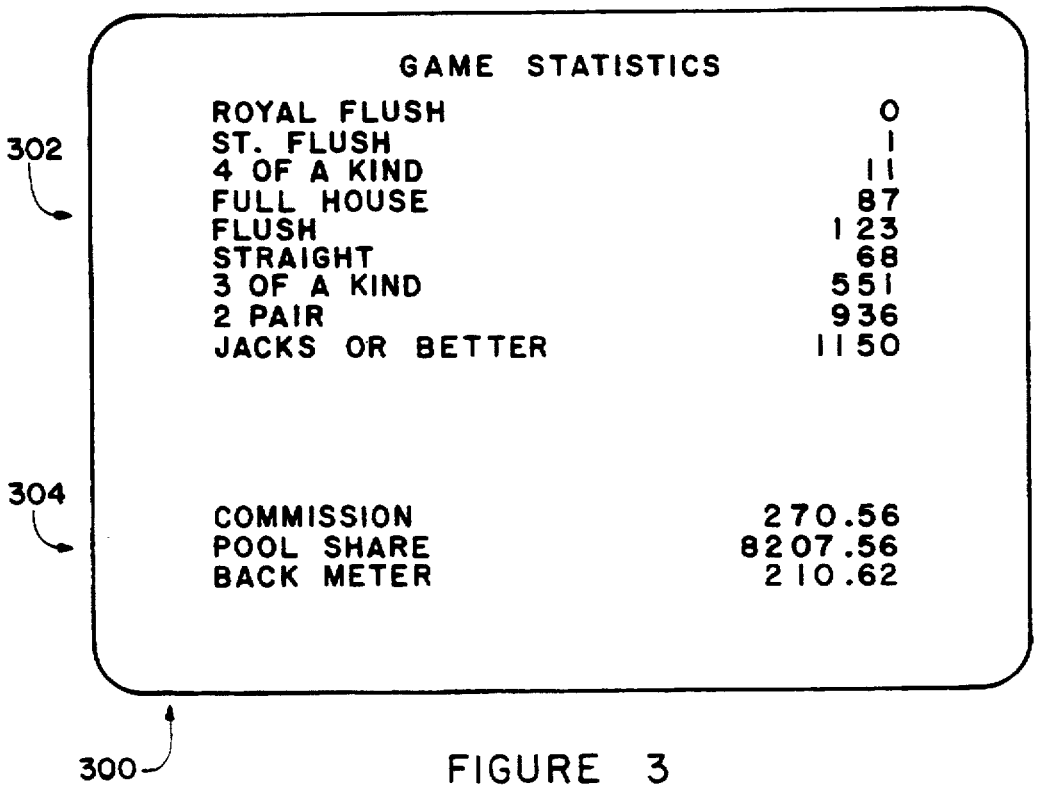
FIG. 3 is a game statistics display.

A game statistics display 300 (FIG. 3) enables the gaming establishment maintaining the game machine 16 to ascertain visually statistics and other information pertinent to the machine 16. In this regard, the display 300 includes a winning poker hand occurrence table 302 indicating the number of times that particular poker hand combinations were awarded. The display 300 further includes a current balance display 304 which indicates the current balance of a house commission account, a common pool account and a back meter account.

Figure 4A:
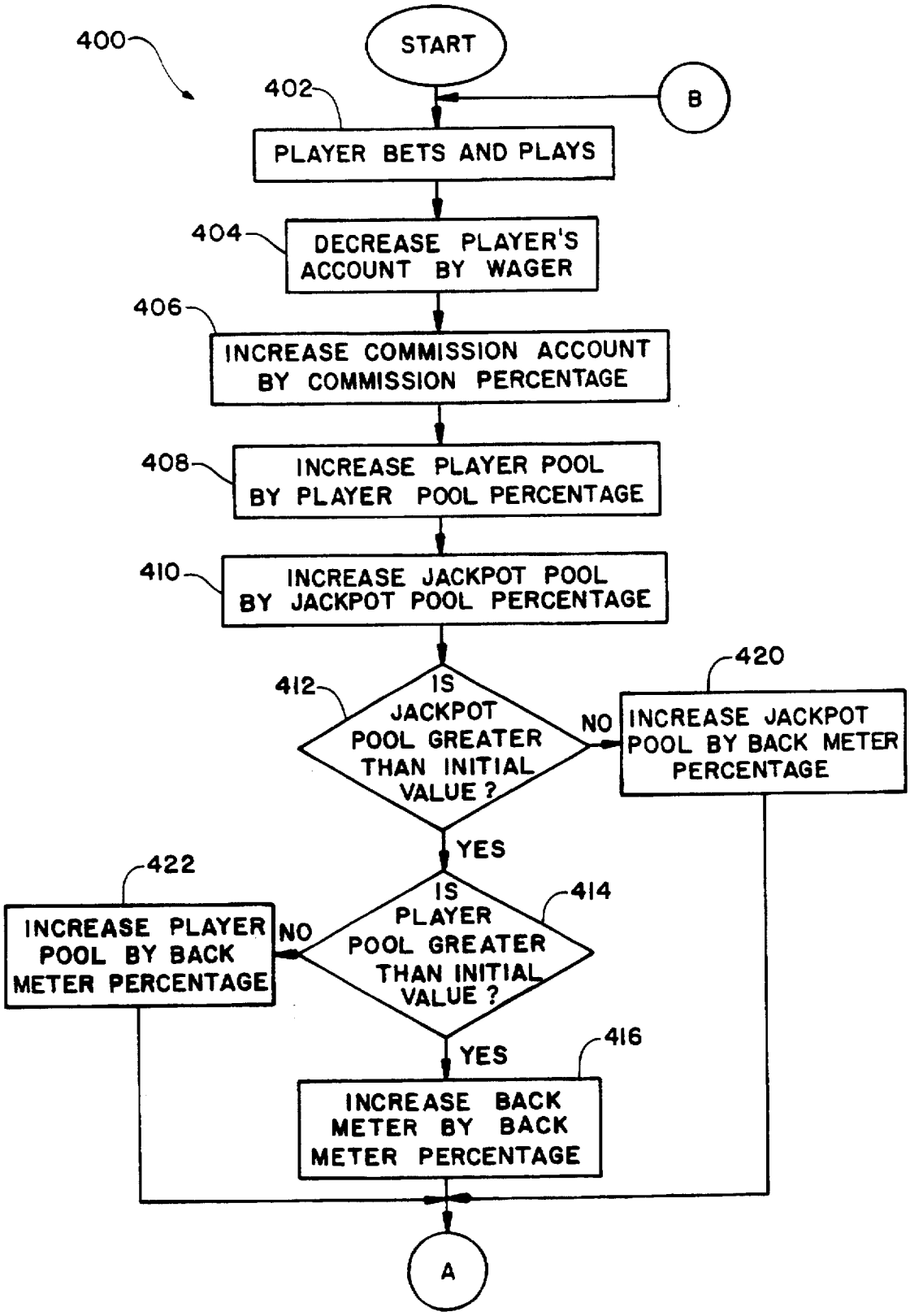
FIG. 4A–4C is a flow diagram of the operation of the present invention.

Considering now the operation of the gaming system 10 with reference to FIG. 4A–4C, the operation of the system 10 is described hereinafter in connection with a video poker game. It will be understood by one skilled in the art that of the system 10 for video poker may be adapted for operating in connection with other games of chance, such as slot machine games and keno games without undue modification or experimentation.

As shown in the operation diagram 400, the player's bet or wager is initially allocated between the house commission account, the player pool account, the jackpot pool account and the back meter account. Upon the player placing a bet and initiating play at box 402 (FIG. 4), the player's account is decreased by an amount corresponding to the wager at box 404. The house commission portion of the wager is added to the house commission account at box 406, the player pool account is increased by the player pool portion of the wager at box 408, and the jackpot pool portion of the wager is added to the jackpot pool account at box 410.

To ensure that the jackpot pool account and the player pool account remain at a value attractive to potential players, the system 10 determines whether the back meter portion of the wager is to be added to the jackpot pool account, the player pool account or to the back meter account. In this regard, the value of the jackpot pool account is compared at decision box 412 to an initial value. The initial value corresponds to a power off value for the jackpot pool account, wherein the power off value is the last value stored for the jackpot pool account.

Where the value of the jackpot pool account is not greater than the jackpot pool account initial value, the back meter portion of the wager is attributed to the jackpot pool account at box 420. Should it be determined at decision box 412 that the jackpot pool is greater than the jackpot pool account initial value, the player pool account is subsequently compared to a player pool account initial value at decision box 414.

The player pool account initial value corresponds to a power off value indicative of the last value stored for the player pool account. Where the player pool account value is not greater than the player pool account initial value, the back meter portion of the wager is attributed to the player pool account at box 422. If the player pool account value is greater than the player pool account: initial value, the back meter portion of the wager is added to the back meter account at box 416.

Figure 4B:
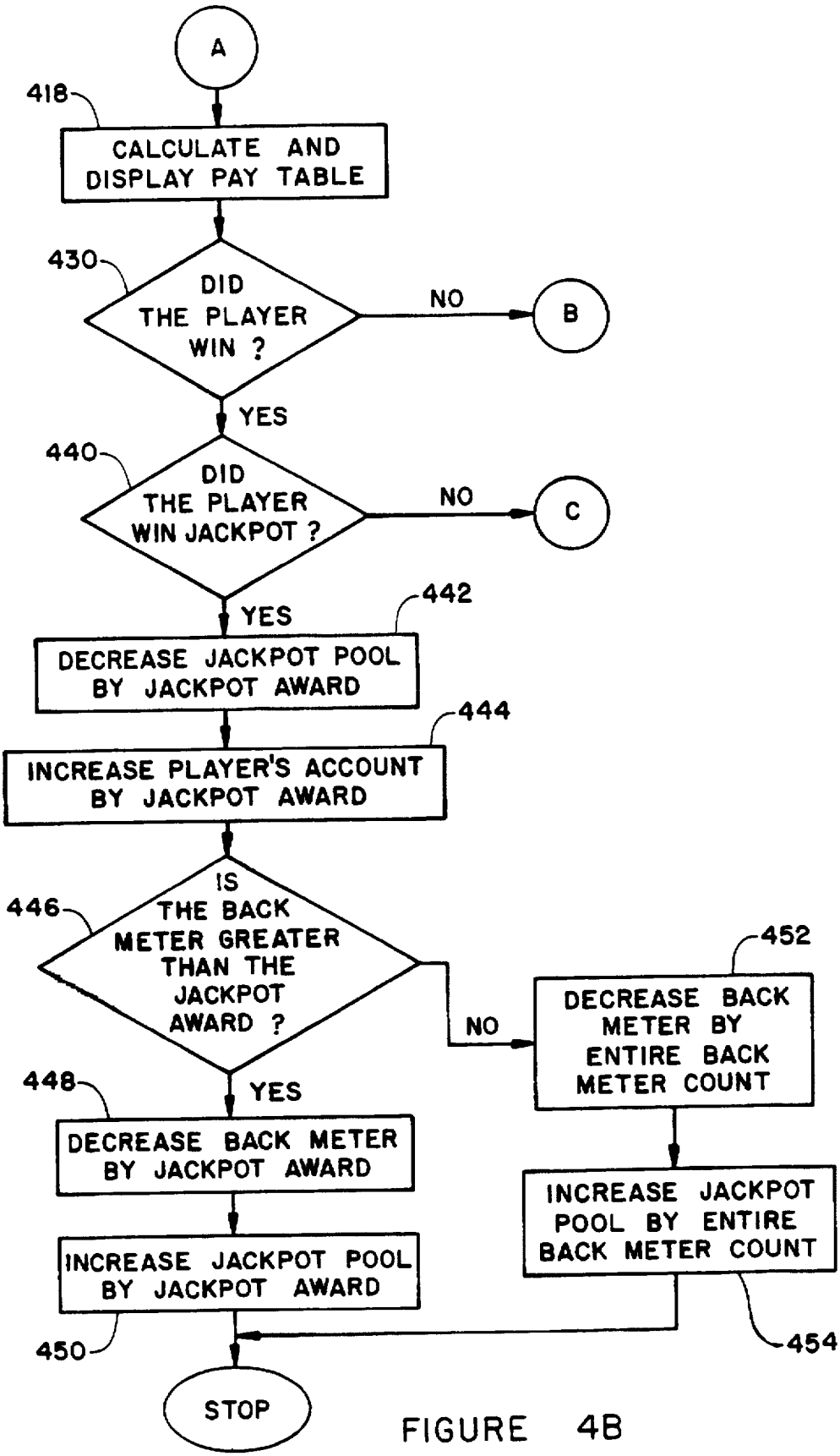
Figure 4C:
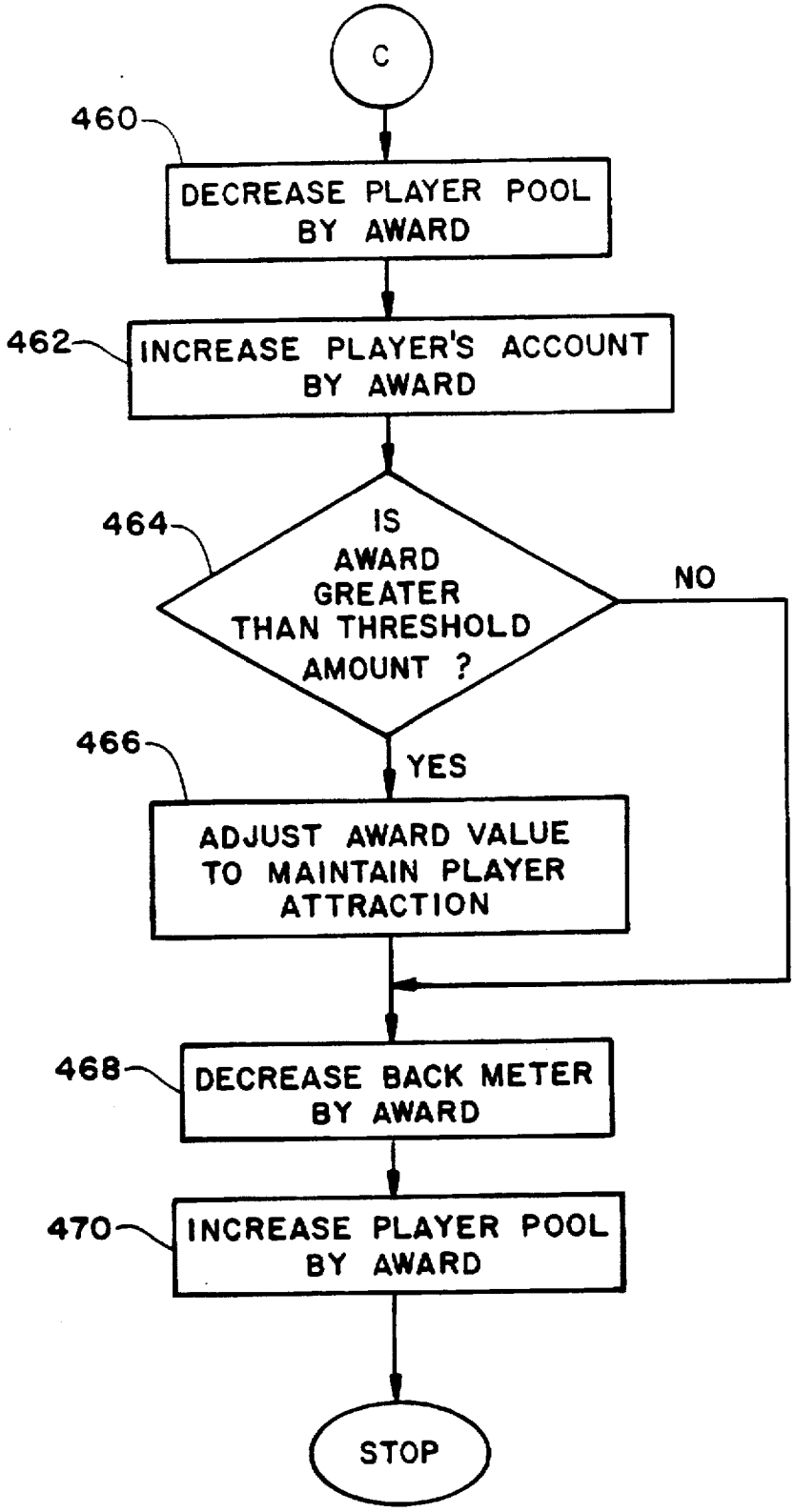

Using the current player pool account balance, the paytable is next determined and displayed at box 418 (FIG. 4B). As described previously, the payouts for each winning combination represent a specified percentage of the current player pool account. Thus, a player cannot deplete the entire player pool as a result of winning a single hand.

The occurrence of a winning hand is detected at decision box 430. Where no winning hand was detected, the operation returns to box 402 to receive another wager from the player. However, if a winning hand is detected, the amount of the award, and the proper transferring of funds must be made. A determination is made at decision box 440 as to whether the winning hand was a jackpot. As the jackpot pool account and the player pool account are separate, the transfer of funds relative to the jackpot pool and the player pool vary.

Where it is detected at decision box 440 that the player won a jackpot, the amount of the jackpot award is deducted or debited from the jackpot pool account at box 442 and attributed or credited to the player's account at box 444. The jackpot award is compared to the back meter account value at decision box 446 to determine how the jackpot pool account will be replenished. If the back meter account value is determined to be greater than the jackpot award at decision box 446, an amount corresponding to the jackpot award will be deducted from the back meter account at box 448 and an amount equal to the jackpot award will be added to the jackpot pool account at box 450, thereby fully replenishing the jackpot pool account. However, where it is determined at decision box 446 that the back meter account value is not greater than the jackpot award, the entire back meter account value will be deducted from the back meter account at box 452 and the back meter account value will be added to the jackpot pool account at box 454.

Where it is detected at decision 440 that the player did not win a jackpot, the jackpot pool account is not involved and the appropriate award is deducted or debited from the player pool account at box 460 (FIG. 4C) and attributed or credited to the player's account at box 462.

To maintain the player pool account at a level which will attract players, the award is compared to a threshold amount at decision box 464. The threshold amount is selected to be sufficiently high to enable the player pool account to grow to an attractive amount, yet low enough to permit the back meter account to grow.

If it is determined at decision box 464 that the award is not greater than the threshold amount, the award will be deducted from the back meter account at box 468 and the award will be attributed to the player pool account at box 470. However, where it is determined at decision box 464 that the award is greater than the threshold amount, the award value is adjusted at box 466.

The adjusted award value is calculated to be the difference between a predetermined default value for the player pool account and the current value of the player pool account after the award has been deducted therefrom. The adjusted award value is then deducted from the back meter account at box 468 and credited to the player pool account at box 470.

For example, where the award is $15.00, the threshold amount is $10.00, the predetermined default value is $100.00 and the player pool account balance prior to the award is $110.00, the adjusted award will be calculated as follows:

$$\begin{aligned} \text{adjusted award} &= 100 - (110 - 15) \\ &= \$5.00 \end{aligned} \quad (1)$$

Figures 5A, 5B:
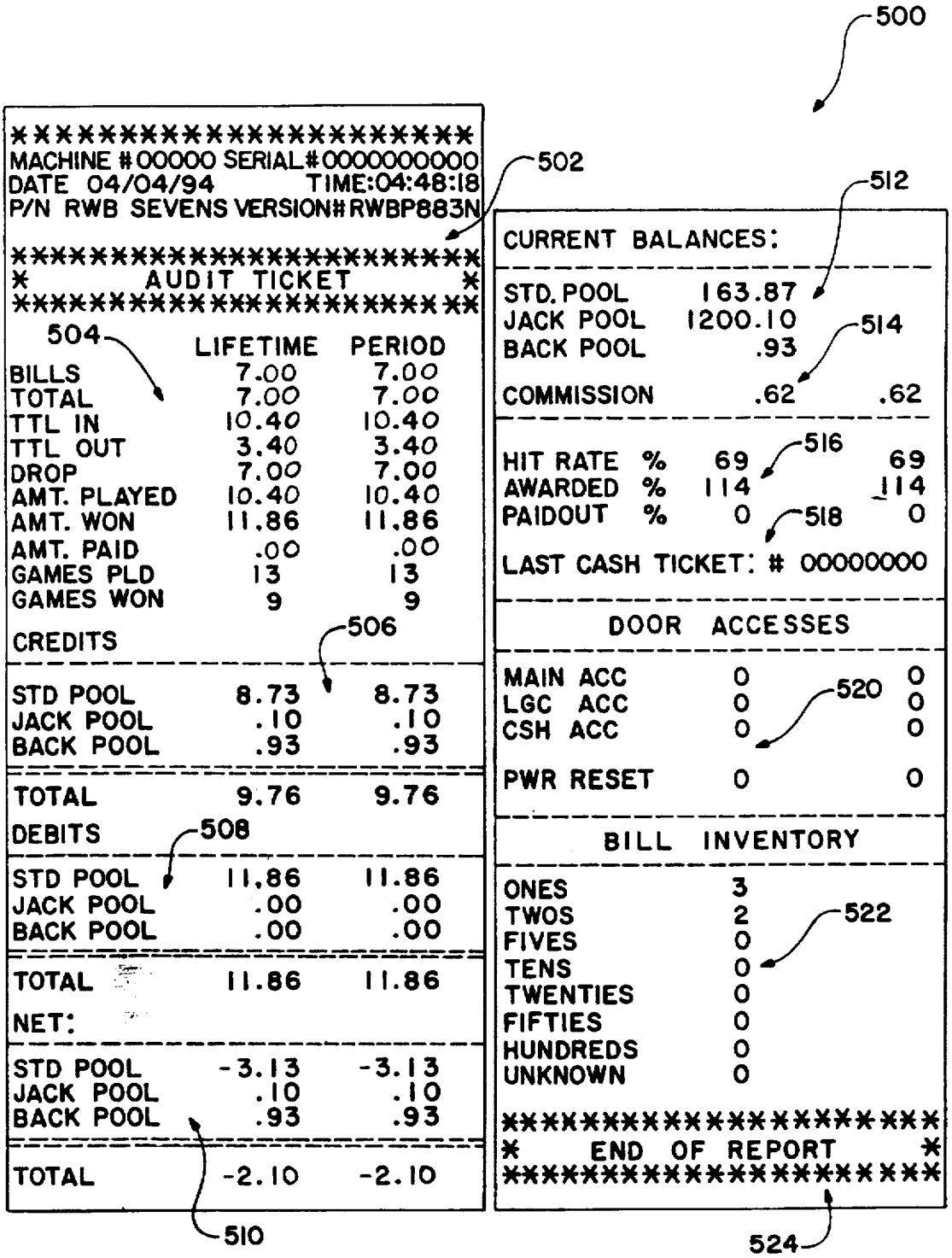
FIG. 5A–5B is an audit ticket prepared in accordance with the present invention.

Considering now the audit ticket 500 of FIGS. 5A–5B, the audit ticket 500 provides accounting information to enable all monies to be accounted for by the gaming establishment. The audit ticket 500 includes a header portion 502 for displaying identifying information, and a summary portion 504 indicating information regarding the amount of money input into the machine 16 as well as information regarding the games played.

The ticket 500 further includes a credit information portion 506 indicating the accumulated credits for the player or standard pool account (STD POOL), the jackpot pool account (JACK POOL) and the back meter account (BACK POOL). A debit information portion 508 indicates total accumulated debits for the player pool account, the jackpot pool account and the back meter account. A net information portion 510 indicates the summation of the credits and debits for the player pool account, the jackpot pool account and the back meter account. As shown in FIG. 5A, the credit, debit and net information is determined for both the life time of the machine 16 and for the period since the last audit ticket was printed.

A current balance portion 512 indicates the current balance of the player pool account, the jackpot pool account and the back meter account. A commission balance portion 514 indicates the current balance of the house commission meter.

A statistical information portion 516 indicates relevant percentages for various activities. A cash ticket identifying portion 518 indicates an identification member for the last cash ticket produced by the machine 16.

The ticket 500 further includes a door access portion 520, a bill inventory portion 522 and a footer portion 524.

Figure 6:
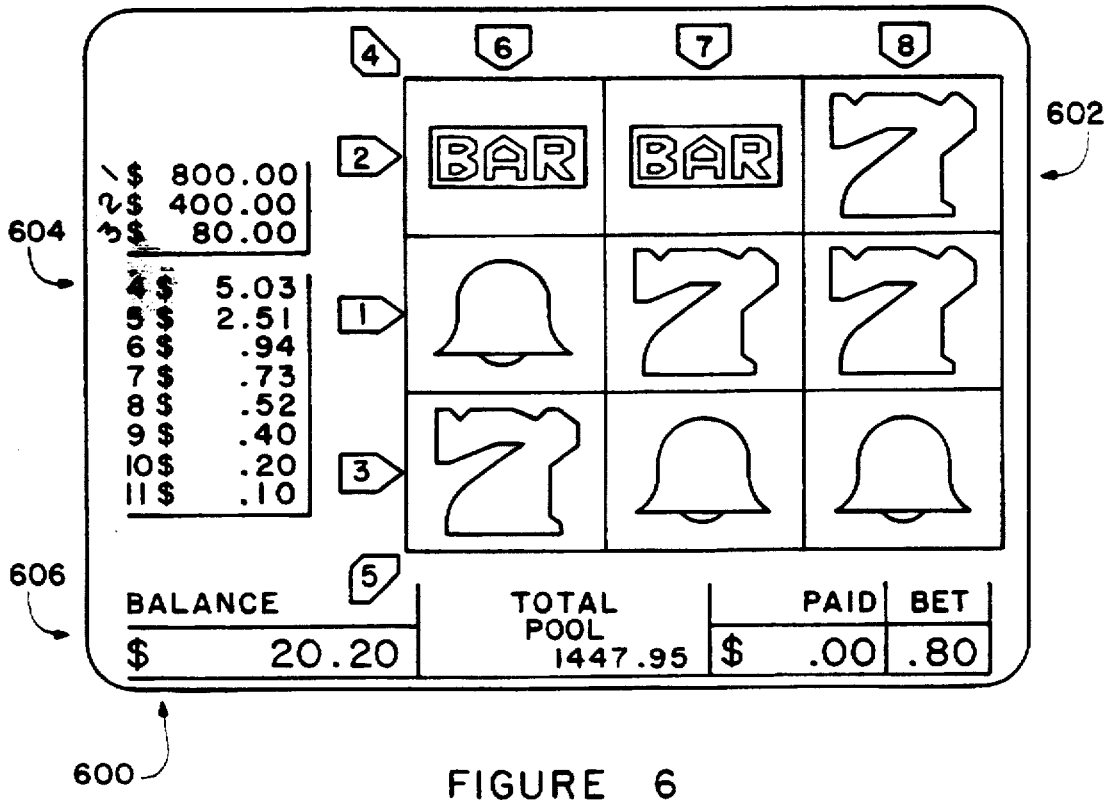
FIG. 6 is a slot machine game display.

Considering now the slot or reel machine game display 600 in greater detail with reference to FIG. 6, the display 600 is substantially similar to the poker display 200 (FIG. 2) and includes a game display 602, a paytable display 604, and a status display 606.

Considering now the keno game display 700 with reference to FIG. 7, the keno game display 700 is substantially similar to the poker game display 200 (FIG. 2) and includes a game display 702, a paytable display 704 and a status display 706.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A pari-mutuel gaming system, comprising:

account means for establishing a player's account having a player's account balance, a player pool account having a player pool balance and a house commission account having a house commission balance to facilitate the distribution of funds between said player's account, said player pool account and said house commission account;

payment means for accepting an amount of player currency to increase said player's account balance by said player currency amount;

betting means responsive to a wager for decreasing said player's account balance by a wager amount, for increasing said player pool balance by a player pool portion of said wager amount to a current player pool balance, and increasing said house commission balance by a commission portion of said wager amount to distribute said player pool portion and said commission portion of said wager amount to said player pool account and said house commission account, respectively;

dynamic paytable means for determining a payout for winning outcomes of an individual game play during each game play time to allocate award portions of said current player pool balance to corresponding ones of said winning outcomes for enabling said player's account balance to be increased by one of said award portions after a successful game play; and payout means for detecting the occurrence of one of said winning outcomes to facilitate the transfer of said award portion corresponding to said one winning outcome from said player pool account to said player's account upon the occurrence of said successful game play, wherein said player's account balance is increased by said award portion and said current player pool balance is decreased by said award portion.

2. A system according to claim 1, wherein said account means further establishes a back meter account having a back meter balance, and said betting means further allocates a back meter portion of said wager amount to said back meter balance.

3. A system according to claim 2, wherein said betting means further compares a predetermined pool value with said player pool balance to determine if said player pool is to be replenished, wherein said player pool balance is increased by said back meter portion when said betting means determines that said player pool requires replenishing.

4. A system according to claim 2, wherein said betting means further increases said back meter balance by said back meter portion.

5. A system according to claim 2, wherein said account means further establishes a jackpot pool account having a jackpot pool balance, and said betting means further increases said jackpot pool balance by a jackpot pool portion of said wager amount.

6. A system according to claim 5, wherein said betting means further compares a predetermined jackpot value with said jackpot pool balance to determine if said jackpot pool is to be replenished, wherein said jackpot pool balance is increased by said back meter portion when said betting means determines that said jackpot pool requires replenishing.

7. A system according to claim 2, wherein said payout means further compares said award portion with a threshold value.

8. A system according to claim 7, wherein said payout means further transfers a replenishment amount corresponding to said award portion from said back meter account to said player pool account.

9. A system according to claim 7, wherein said payout means further adjusts said award portion to an adjusted award portion to maintain said player pool balance at a sufficient level to attract participation.

10. A system according to claim 9, wherein said payout means further transfers a replenishment amount corresponding to said adjusted award portion from said back meter account to said player pool account.

11. A system according to claim 5, wherein said paytable further determines a jackpot payout for winning jackpot outcomes of said game play to allocate jackpot award portions of said jackpot pool balance to corresponding ones of said winning jackpot outcomes, and said payout means further detects the occurrence of one of said winning jackpot outcomes to facilitate the transfer of said jackpot award portion corresponding to said winning jackpot outcome to said player's account.

12. A system according to claim 11, wherein said payout means further compares said back meter balance to said jackpot award portion.

13. A system according to claim 12, wherein said payout means further transfers a jackpot replenishing amount corresponding to said jackpot award portion from said back meter account to said player pool account.

14. A system according to claim 12, wherein said payout means further transfers said back meter balance in its entirety from said back meter account to said jackpot pool account.

15. A system according to claim 1, further including presentation means for displaying said player's account balance, said award portions and said player pool balance to enable an exact determination thereof to be made.

16. A system according to claim 5, further including means for accumulating all credits and debits charged to said player pool account, said back meter account, said jackpot account and said house commission account, and for determining a net total of said credits and debits, to facilitate accounting practices for the gaming system.

17. A system according to claim 16, further including means for printing an audit ticket indicating said credits, debits and net total in currency form thereon.

18. A method of operating a pari-mutuel gaming system, comprising:

establishing a player's account having a player's account balance, a player pool account having a player pool balance and a house commission account having a house commission balance to facilitate the distribution of funds between said player's account, said player pool account and said house commission account;

accepting an amount of player currency to increase said player's account balance by said player currency amount;

decreasing said player's account balance by a wager amount, increasing said player pool balance by a player pool portion of said wager amount to a current player pool balance, and increasing said house commission balance by a commission portion of said wager amount to distribute said player pool portion and said commission portion of said wager amount to said player pool account and said house commission account, respectively;

determining a payout for winning outcomes of an individual game play during each game play time to allocate award portions of said current player pool balance to corresponding ones of said winning outcomes for enabling said player's account balance to be increased by one of said award portions after a successful game play; and detecting the occurrence of one of said winning outcomes to facilitate the transfer of said award portion corresponding to said one winning outcome from said player pool account to said player's account upon the occurrence of said successful game play, wherein said player's account balance is increased by said award portion and said current player pool balance is decreased by said award portion.

19. A method according to claim 18, further including establishing a back meter account having a back meter balance, allocating a back meter portion of said wager amount to said back meter balance, and increasing said back meter balance by said back meter portion.

20. A method according to claim 19, further including establishing a jackpot pool account having a jackpot pool balance, and increasing said jackpot pool balance by a jackpot pool portion of said wager amount.

21. A method according to claim 20, further including displaying said player's account balance, said award portions and said player pool balance to enable an exact determination thereof to be made.

22. A method according to claim 21, further including accumulating all credits and debits charged to said player pool account, said back meter account, said jackpot account and said house commission account, determining a net total of said credits and debits, and printing an audit ticket indicating said credits, debits and net total in currency form thereon.

23. An audit ticket created according to the method of claim 22.

* * * * *